US010865062B2

(12) United States Patent
Miyakawa

(10) Patent No.: US 10,865,062 B2
(45) Date of Patent: Dec. 15, 2020

(54) MEDIUM TRANSPORT DEVICE, PRINTING APPARATUS, AND METHOD FOR MANUFACTURING MEDIUM TRANSPORT DEVICE

(71) Applicant: Seiko Epson Corporation, Tokyo (JP)

(72) Inventor: Takuya Miyakawa, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/365,795

(22) Filed: Mar. 27, 2019

(65) Prior Publication Data

US 2019/0299666 A1 Oct. 3, 2019

(30) Foreign Application Priority Data

Mar. 28, 2018 (JP) ..... 2018-061410

(51) Int. Cl.

| | |
|---|---|
| ***B65H 5/06*** | (2006.01) |
| ***B41J 13/03*** | (2006.01) |
| ***B41N 7/00*** | (2006.01) |
| ***B41J 27/12*** | (2006.01) |

(52) U.S. Cl.

CPC ..... *B65H 5/06* (2013.01); *B41J 13/03* (2013.01); *B41J 27/12* (2013.01); *B41N 7/005* (2013.01); *B65H 2404/18* (2013.01); *B65H 2404/181* (2013.01); *B65H 2404/186* (2013.01); *B65H 2404/187* (2013.01)

(58) Field of Classification Search

CPC ..... B65H 5/06; B65H 2404/186; B65H 2404/181; B65H 2404/187; B65H 2404/18; B41J 27/12; B41J 13/03; B41N 7/005

See application file for complete search history.

(56) References Cited

U.S. PATENT DOCUMENTS

| | | | | |
|---|---|---|---|---|
| 6,077,207 A * | 6/2000 | Yokoyama | ..... | B65H 27/00 492/18 |
| 2002/0034392 A1* | 3/2002 | Baum | ..... | G03D 3/00 396/564 |
| 2017/0120632 A1 | 5/2017 | Nakahata et al. | | |

FOREIGN PATENT DOCUMENTS

| | | |
|---|---|---|
| JP | 2016-169107 A | 9/2016 |
| JP | 2017-088260 A | 5/2017 |

* cited by examiner

*Primary Examiner* — Geoffrey S Mruk

(74) *Attorney, Agent, or Firm* — Hamess, Dickey & Pierce, P.L.C.

(57) ABSTRACT

A medium transport device includes a roller transporting a medium, such as recording paper; a first layer covering a surface of the roller facing the medium; a second layer laminated on the first layer; and convex portions provided between the first layer and the second layer, and the convex portions are formed from inorganic particles. The first layer binds the convex portions to the roller, and the second layer covers the convex portions for protection.

20 Claims, 9 Drawing Sheets

MEDIUM TRANSPORT DEVICE, PRINTING APPARATUS, AND METHOD FOR MANUFACTURING MEDIUM TRANSPORT DEVICE

The entire disclosure of Japanese Patent Application No. 2018-061410, filed Mar. 28, 2018 is expressly incorporated by reference herein.

BACKGROUND

1. Technical Field

The present invention relates to a medium transport device including a roller which comes into contact with a medium and rotates therewith to transport the medium, a printing apparatus, and a method for manufacturing a medium transport device.

2. Related Art

For example, a printing apparatus, such as a printer, a copying machine, or a facsimile apparatus, has at least one roller which comes into contact with a sheet-shaped medium, such as recording paper (hereinafter, abbreviated as "paper"), and rotates therewith to transport the medium. For example, a printer disclosed in JP-A-2017-088260 includes a correction roller pair which pinches paper and rotates therewith so as to transport the paper to a printing portion. Some of the rollers described above each have a plurality of projections on the outer circumference surface thereof in order to increase the friction with paper. JP-A-2017-088260 has discloses an example in which one correction drive roller of the above correction roller pair has a plurality of convex portions point-contactable to the paper, and the convex portions are formed of ceramic particles embedded so as to project from a surface of a binding agent layer provided on the outer circumference surface of the roller.

However, depending on the application of printing, an organic solvent-based liquid may be ejected from the printing portion in some cases, and if the binding agent layer is degraded by this liquid adhered thereto, the convex portions may fall off from the roller in some cases. In addition, in recent years, since an increase in printing speed has been demanded, the durability of the roller is more likely to become a subject required to be discussed.

SUMMARY

An advantage of some aspects of the invention is to provide a medium transport device capable of improving the durability, a printing apparatus, and a method for manufacturing a medium transport device.

In order to achieve the above object, a medium transport device of the invention comprises; a roller transporting a medium; a first layer covering a surface of the roller facing the medium; a second layer laminated on the first layer; and convex portions provided between the first layer and the second layer, and the convex portions include inorganic particles.

According to the invention, since the convex portions provided between the first layer and the second layer include the inorganic particles, and the inorganic particles bound to the roller by the first layer are protected by the second layer, the inorganic particles are not likely to fall off, and while a friction force with the medium is secured, the durability of the roller can be improved.

In the structure described above, the second layer preferably includes an inorganic material.

According to this structure, the durability and chemical resistance of the second layer can be improved, and hence, the durability of the roller can be improved.

In addition, in the structure described above, the first layer preferably includes an inorganic material.

According to this structure, the inorganic particles can be tightly bound to the roller by the first layer, and hence, the durability of the roller can be improved.

In addition, in the structure described above, the inorganic material preferably includes an electrically conductive substance.

According to this structure, even when being generated, the static electricity can be removed.

In the structure described above, the electrically conductive substance preferably includes carbon particles.

According to this structure, in the formation of the first layer or the second layer, the layer is colored by those carbon particles, and hence, if defects, such as cracks and/or variation in film thickness, occur, those defects can be easily detected.

In the structure described above, the inorganic particles may include an aluminum oxide.

According to this structure, since the aluminum oxide is used as the inorganic particles, the convex portions can be further hardened, and hence, the friction force of the roller with the medium is increased.

In addition, a printing apparatus of the invention comprises: any one of the medium transport devices described above; and a printing portion which performs printing by ejecting a liquid to the medium.

According to this structure, since the medium transport device capable of improving the durability of the roller is included while the friction force with the medium is secured, a product life can be improved.

Furthermore, a method for manufacturing a medium transport device of the invention is a method for manufacturing any one of the medium transport devices described above, and the method of the invention comprises: a step of forming a precursor of the first layer on the roller; a step of adhering the inorganic particles to the precursor of the first layer; a step of forming the first layer by firing the precursor of the first layer to which the inorganic particles are adhered; a step of forming a precursor of the second layer on the first layer to which the inorganic particles are adhered; and a step of forming the second layer by firing the precursor of the second layer.

According to the invention, the outer circumference surface of the roller can be formed to have the convex portions by the inorganic particles provided between the first layer and the second layer. In addition, since the inorganic particles bound to the roller by the first layer are protected by the second layer, the inorganic particles are not likely to fall off, and as a result, while the friction force with the medium is secured, the durability of the roller can be improved.

In the manufacturing method described above, at least one of the precursor of the first layer and the precursor of the second layer may include a compound containing a polysilazane.

By this manufacturing method, since a silica film which is an inorganic material can be formed by firing, the durability and chemical resistance of the roller are improved.

In addition, in the manufacturing method described above, the compound containing a polysilazane preferably includes an amine.

According to this manufacturing method, a firing temperature can be decreased. Hence, the degree of freedom of selecting a material of a roller main body is improved.

In addition, in the manufacturing method described above, at least one of the precursor of the first layer and the precursor of the second layer may include a compound containing a silsesquioxane.

In addition, in the manufacturing method described above, at least one of the step of forming a precursor of the first layer and the step of forming a precursor of the second layer preferably includes an electrostatic coating method.

According to this manufacturing method, even if the roller has a larger length, a film can be formed to have a more uniform thickness.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. In addition, in the following embodiments, although various limitations are described as preferable concrete examples of the invention, the scope of the invention is not limited to those embodiments unless otherwise specifically noted to limit the invention in the following description. In addition, in the following description, the structure in which a medium transport device of the invention is applied to an ink jet type recording apparatus (hereinafter, simply referred to as "printer") which is one embodiment of a printing apparatus will be described by way of example.

Figure 1:
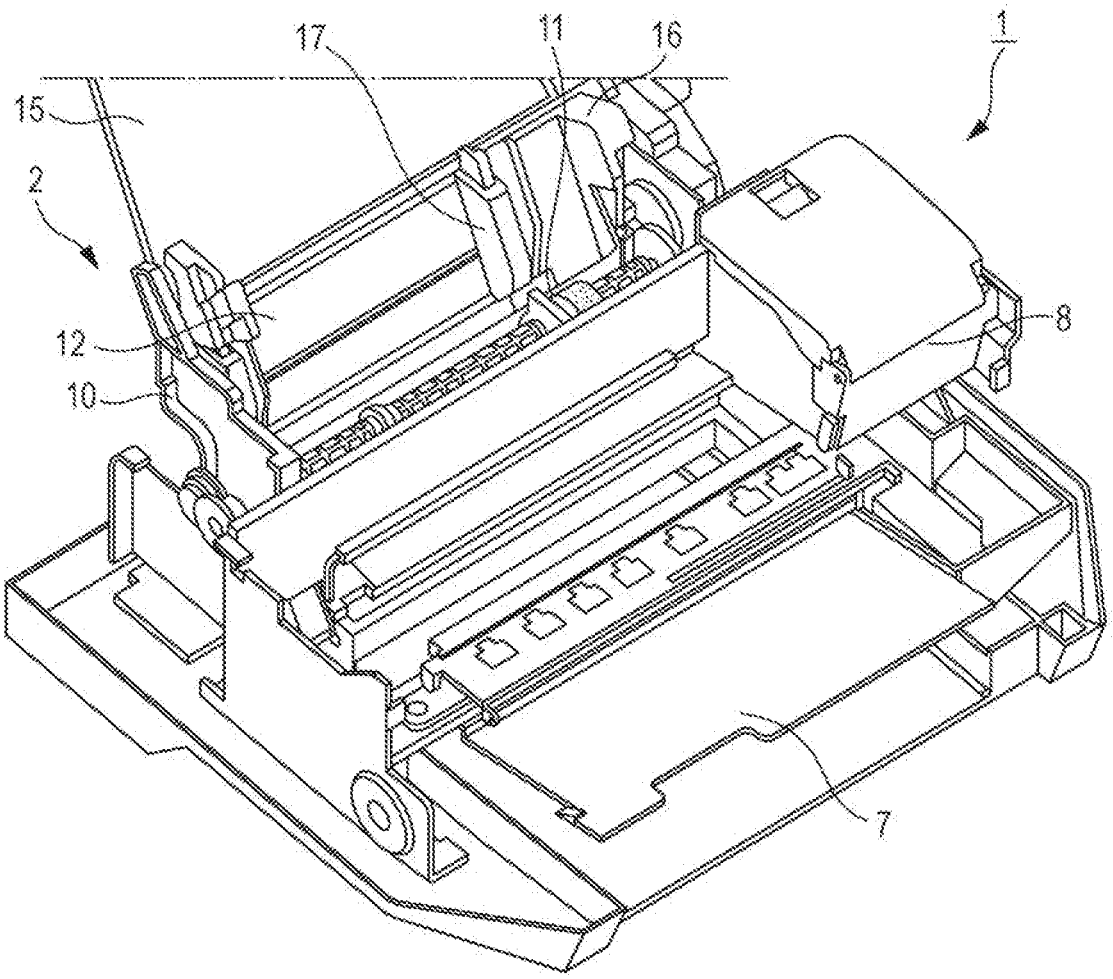
FIG. 1 is a perspective view illustrating the structure of one embodiment of a printing apparatus.
Figure 2:
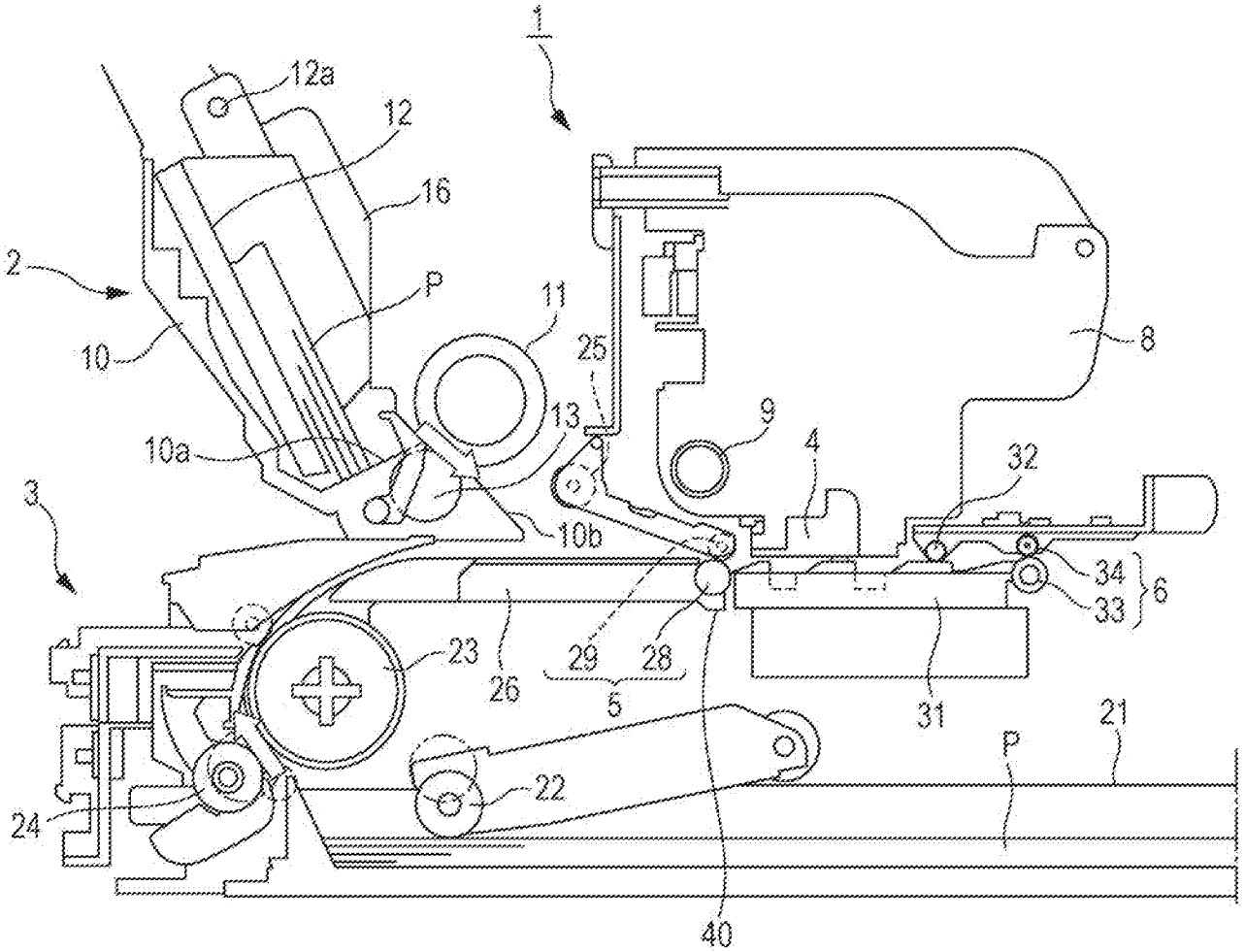
FIG. 2 is a schematic view illustrating a side surface structure of the printing apparatus.

FIG. 1 is a perspective view of an apparatus main body (state in which an exterior cover is removed) of a printer 1, and FIG. 2 is a schematic view illustrating a side surface structure of the printer 1. This printer 1 includes a rear feeding device 2 at a rear portion of the apparatus and a front feeding device 3 at a bottom portion of the apparatus and is configured so that from those two feeding devices 2 and 3, recording paper (hereinafter, referred to as "paper P") functioning as a sheet-shaped medium is transported to a medium transport mechanism 5 (one type of medium transport device of the invention). As the medium, besides regular paper, for example, coated paper or a film formed from a synthetic resin may be used. The paper P is fed by the medium transport mechanism 5 toward a recording head 4 which is one type of printing portion and, after an image or the like is printed, is discharged to a stacker 7 (or a paper output tray) by a medium discharge mechanism 6.

The rear feeding device 2 includes a frame 10 forming a base body of the device, a hopper 12, a feeding roller 11, a retard roller 13, a support plate 15, a movable edge guide 17, a fixed edge guide 16, and a return lever 19. The hopper 12 is formed of a plate body, is provided swingably around an upper swingable fulcrum point 12*a*, and is configured so that a pressure contact pose in which the paper P slantingly supported on the hopper 12 is pressure-contacted to the feeding roller 11 and a separation pose in which the paper P is separated from the feeding roller 11 are switched to each other. At a position facing the lower end of the hopper 12, a front contact surface 10*a* with which the front end of the paper comes into contact is provided. In addition, in association with the swinging movement of the hopper 12, the paper P set therein is guided to the feeding roller 11 while sliding on the front contact surface 10*a*. In addition, at a downstream side of the feeding roller 11, a guide surface 10*b* is provided, and the paper P fed from the feeding roller 11 is transported to a downstream side along this guide surface 10*b*. This feeding roller 11 is a cylindrical hollow member formed from an elastic material and is rotated by a drive force of a drive motor not shown, so that the topmost paper P pressure-contacted by the hopper 12 is fed to the downstream side. The retard roller 13 is provided pressure-contactable with the feeding roller 11 and functions as a separating unit which prevents a plurality of paper P from being simultaneously transported.

The support plate 15 (see FIG. 1) extends a paper support surface of the hopper 12 in a rear end direction of the paper P to supports a rear end portion thereof. The movable edge guide 17 and the fixed edge guide 16 are provided to the hopper 12 so as to face each other and are in contact with the edges of the paper P so as to control the position thereof. Of the two guides described above, the movable edge guide 17 is provided slidably along the hopper 12 in a width direction of the paper P, and hence, the paper P can be disposed at an appropriate position suitable for the width dimension thereof.

The front feeding device 3 provided at the bottom portion of the printer 1 so that the paper P is set from the front side of the apparatus includes a paper feeding cassette 21, a pick up roller 22, a feeding roller 23, and a retard roller 24. In the paper feeding cassette 21 detachably from the front side of the apparatus, a plurality of the paper P can be set in a laminated state. The pick up roller 22 rotationally driven by a motor not shown is rotated while being in contact with the topmost paper P set in the paper feeding cassette 21, so that the topmost paper P is fed out of the paper feeding cassette 21. In addition, the feeding roller 23 reverses the topmost paper P fed out of the paper feeding cassette 21 by warping and then feeds the paper P to the medium transport mechanism 5 through a guide plate 26. In addition, the feeding roller 23 and the retard roller 24 of the front feeding device 3 have the structures similar to those of the feeding roller 11 and the retard roller 13, respectively, of the rear feeding device 2.

At a downstream side of the rear feeding device 2 and the front feeding device 3, a paper detection unit (not shown) detecting the passage of the paper P, a guide roller 25 forming a feeding pose of the paper P fed from the rear feeding device 2, and the guide plate 26 guiding the paper P to the medium transport mechanism 5 are provided.

The medium transport mechanism 5 is formed of a feeding drive roller 28 (one type of roller of the invention) rotationally driven by a motor and a feeding driven roller 29 rotationally driven while being pressure-contacted with the feeding drive roller 28. The paper P reaching the medium transport mechanism 5 is transported onto a platen 31 disposed under the recording head 4 by the rotation of the feeding drive roller 28 while the paper P is pinched between the feeding drive roller 28 and the feeding driven roller 29.

The recording head 4 which is one type of printing portion of the invention is provided at a bottom portion of a carriage 8. The carriage 8 is configured to perform a printing operation (that is, liquid ejection operation) of printing an image or the like by ejecting an ink which is one type of liquid to the paper P transported by the medium transport mechanism 5 while the carriage 8 is reciprocally moved in a main scan direction by a drive motor not shown along a guide shaft 9 extending in the main scan direction. In addition, the carriage 8 mounts ink cartridges (not shown) of a plurality of colors, and the ink is supplied from this ink cartridge to the recording head 4.

The platen 31 is provided at a position facing the recording head 4, and by this platen 31, the distance between the paper P and the recording head 4 is determined. At a downstream side of the recording head 4, there are provided an auxiliary roller 32 preventing floating of the paper P from the platen 31 and the medium discharge mechanism 6 discharging the paper P on which recording is performed. The medium discharge mechanism 6 is formed of a discharge drive roller 33 rotationally driven by a motor not shown and a discharge driven roller 34 rotationally driven while being in contact with the discharge drive roller 33. Since the discharge drive roller 33 is rotationally driven while the paper P is pinched by the discharge drive roller 33 and the discharge driven roller 34, the paper P on which an image, a text, or the like is recorded (that is, the ink is ejected) by the recording head 4 is discharged to the stacker 7 provided at a front side of the apparatus.

Figure 3:
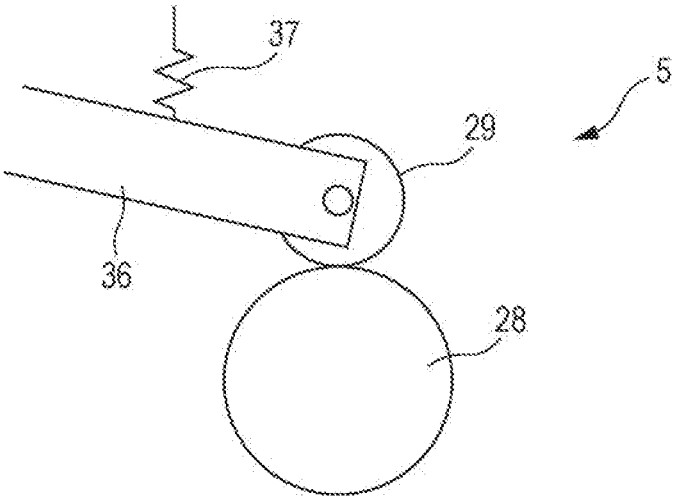
FIG. 3 is a schematic view illustrating the structure of one embodiment of a medium transport device.
Figure 4:
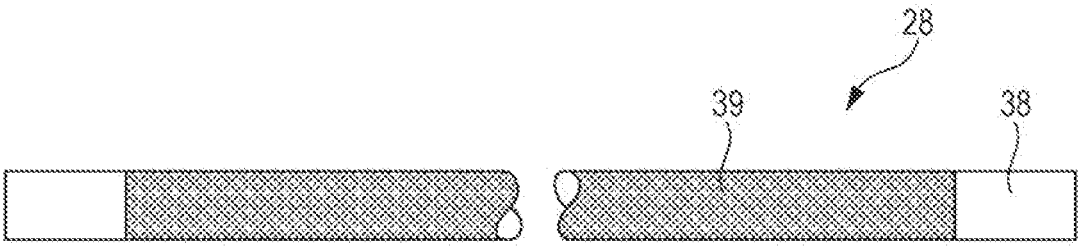
FIG. 4 is a front view illustrating the structure of one embodiment of a roller.
Figure 5:
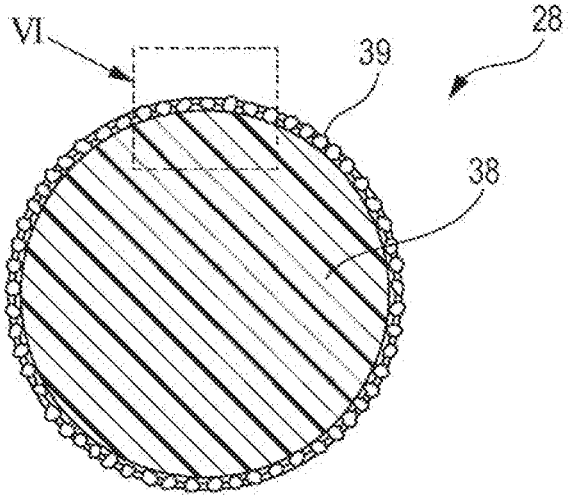
FIG. 5 is a cross-sectional view illustrating the structure of one embodiment of the roller.
Figure 6:
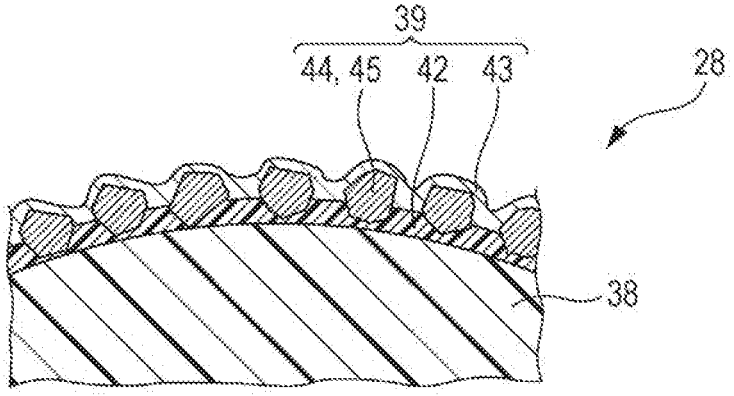
FIG. 6 is an enlarged view of the roller.

FIG. 3 is a schematic view illustrating the structure of the medium transport mechanism 5. FIG. 4 is a front view illustrating the structure of the feeding drive roller 28, and FIG. 5 is a cross-sectional view illustrating the structure of the feeding drive roller 28. Furthermore, FIG. 6 is an enlarged view of the region VI shown in FIG. 5. The feeding driven roller 29 is rotatably supported by an arm 36 and is disposed at a position in contact with the feeding drive roller 28. The arm 36 is provided with a biasing member 37, and because of a biasing force by the biasing member 37, the feeding driven roller 29 is biased toward the feeding drive roller 28. In addition, the feeding driven roller 29 is rotated in accordance with the rotation of the feeding drive roller 28 while pinching the paper P with the feeding drive roller 28. The feeding drive roller 28 which is one type of roller of the invention includes, for example, a roller main body 38 formed of a metal, such as stainless steel, or a synthetic resin to which electrical conductivity is imparted and a friction layer 39 (corresponding to the outer circumference surface of the roller of the invention) provided on the outer circumference surface of this roller main body 38. Two end portions of this feeding drive roller 28 are rotatably supported by at least one bearing 40 (see FIG. 2).

The friction layer 39 of this embodiment is formed on the roller main body 38 except for the two end portions thereof as shown in FIG. 4. This friction layer 39 has a two-layer structure including a first cover layer 42 (corresponding to a first layer of the invention) formed on the outer circumference surface of the roller main body 38 and a second cover layer 43 (corresponding to a second layer of the invention) laminated on the first cover layer 42. In addition, between the first cover layer 42 and the second cover layer 43 of the friction layer 39, a plurality of convex portions 44 is formed. The convex portions 44 are formed of portions of the second cover layer 43 which are projected by the inorganic particles 45 provided between the cover layers 42 and 43. That is, the convex portions 44 are formed by the inorganic particles 45 provided between the cover layers 42 and 43. The first cover layer 42 and the second cover layer 43 of this embodiment are cover layers each formed of an inorganic material and are each a silica film obtained by firing a compound containing a polysilazane which is a precursor. Accordingly, since the inorganic particles 45 can be more tightly bound to the roller main body 38 by the first cover layer 42, the durability of the feeding drive roller 28 can be improved. In addition, since the second cover layer 43 which is in direct contact with a medium can improve the durability and the chemical resistance, the durability of the feeding drive roller 28 can be improved. In addition, the inorganic material described above is not limited to a material only containing an inorganic component and, for example, may also be a so-called organic/inorganic hybrid material containing both an inorganic component and an organic component.

Furthermore, in the first cover layer 42 and the second cover layer 43 of this embodiment, for example, carbon particles are contained as an electrically conductive substance, and hence, the electrical conductivity is imparted to the cover layers. Accordingly, static electricity generated when the paper P is transported can be removed. In addition, since containing the carbon particles, the cover layers 42 and 43 are colored, and when defects, such as cracks and/or variation in film thickness, occur in the film formation of the cover layers 42 and 43, the defects described above can be easily detected.

As the inorganic particles 45, for example, there may be used ceramic particles, such as silicon carbide (SiC), silicon dioxide ($SiO_2$), cubic boron nitride (CBN), or aluminum oxide ($Al_2O_3$). In this embodiment, a pulverized aluminum oxide (hereinafter, referred to as "alumina") is used. The average particle diameter of the inorganic particles 45 is, for example, approximately 20 to 30 μm. As described above, when alumina is used as the inorganic particles 45, the convex portions 44 can be further hardened, and hence, the friction force of the feeding drive roller 28 with the medium can be increased. In addition, the first cover layer 42 functions as a binding layer binding the convex portions 44 to the roller main body 38, and the second cover layer 43 functions as a protective layer suppressing the convex portions 44 from being abraded and falling off. Since the feeding drive roller 28 includes the friction layer 39 as described above, a higher durability, solvent resistance, and a high friction force with the paper P are obtained.

Figure 7:
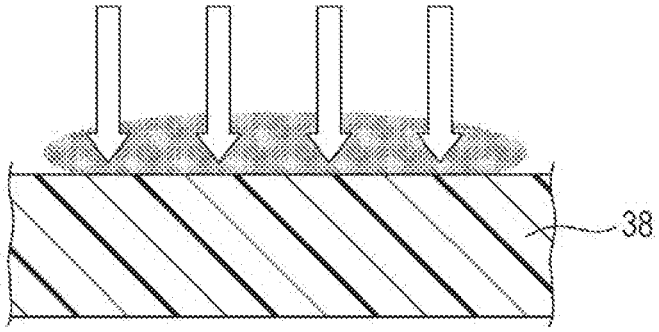
FIG. 7 is a view showing one step of manufacturing the medium transport device.
Figure 8:
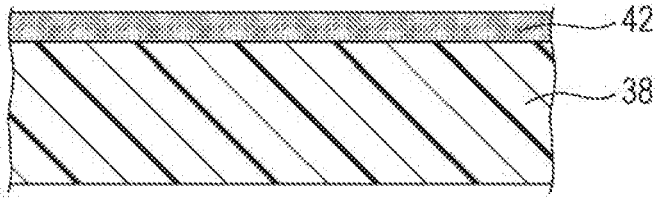
FIG. 8 is a view showing another step of manufacturing the medium transport device.

FIGS. 7 to 11 are views each illustrating a step of manufacturing the medium transport mechanism 5 of a process of manufacturing the printing apparatus 1, and in particular, are views each illustrating a step of forming the friction layer 39 of the feeding drive roller 28. First, as shown in FIG. 7, a first washing step of washing the roller main body is performed. As a washing treatment in this first washing step, for example, $O_2$ plasma washing may be used. Next, as shown in FIG. 8, a step (that is, corresponding to a step of forming a precursor of the first layer of the invention) of forming a first precursor layer 42' to be formed into a precursor of the first cover layer 42 is performed on the surface of the roller main body 38. In this embodiment, since an organic solvent solution containing a polysilazane is coated as a film material on the surface of the roller main body 38, the first precursor layer 42' is formed. In this embodiment, as described above, the carbon particles and additives, such as an amine-based catalyst, are added to the film material. Since the amine is added as the catalyst, in the following firing step (in particular, a first firing step and a second firing step), a reaction of the polysilazane can be promoted, and hence, a firing temperature can be decreased. Accordingly, for example, as a material of the roller main body 38, a material, such as a thermoplastic resin, which is relatively weak to heat, may be selected, and as a result, the degree of freedom of selecting the material of the roller main body is improved. For the formation of the first precursor layer 42', a dip coating method and a wet electrostatic coating method may be used. In this embodiment, the film formation of the first precursor layer 42' is performed by an electrostatic coating method.

Figure 13:
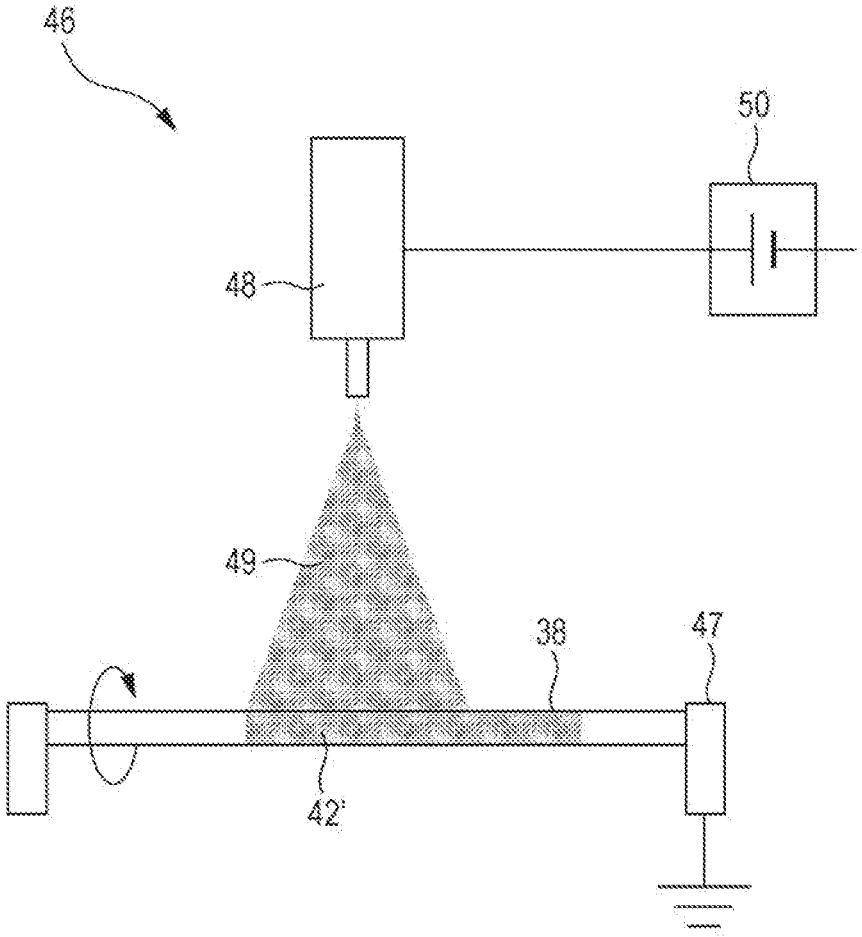
FIG. 13 is a schematic view illustrating the structure of an electrostatic coating apparatus.

FIG. 13 is a schematic view illustrating the structure of an electrostatic coating apparatus 46 used in the film formation step. The roller main body 38 is axially rotatably supported at two end portions thereof by a chuck and is further grounded through this chuck 47. In addition, a nozzle 48 ejecting a film material 49 is provided to face the roller main body 38 axially supported by the chuck 47. A power source portion 50 is connected to the nozzle 48, and a positive voltage is applied thereto. Hence, the film material 49 ejected from the nozzle 48 is positively charged. In the film formation step, when the roller main body 38 is relatively moved together with the nozzle 48 while being axially rotated, the film material 49 is ejected from the nozzle 48 for the film formation. In this embodiment, the positive voltage is applied to the nozzle 48, and the roller main body 38 is grounded; hence, between the nozzle 48 and the roller main body 38, the electric field is formed. When the film material 49 positively charged by the application of the voltage is ejected in the form of liquid droplets by an electrostatic force from a front end of the nozzle 48, the liquid droplets are finely divided, and the finely divided liquid droplets are repelled to each other to form mist. The positively charged mist of the film material 49 is attracted toward the roller main body 38 thus grounded and is adhered thereto, and a solvent of the film material 49 thus adhered is evaporated, so that the first precursor layer 42' is formed on the surface of the roller main body 38. Since the film formation is performed by electrostatic coating as described above, even if the feeding drive roller 28 has a larger length, a more uniform film can be formed. In addition, besides the film formation method of the first precursor layer 42' described by way of example, various film formation methods may also be used. In addition, instead of grounding the roller main body 38, the structure in which a voltage having a polarity opposite to that of the voltage applied to the nozzle 48 is applied to the roller main body 38 may also be used.

Figure 9:
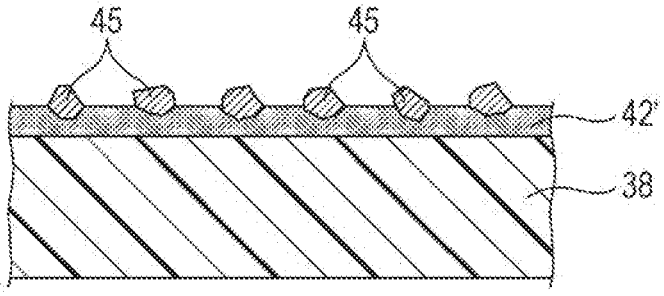
FIG. 9 is a view showing another step of manufacturing the medium transport device.

After the first precursor layer 42' is formed, as shown in FIG. 9, a step (that is, corresponding to a step of adhering the inorganic particles to the precursor of the first layer of the invention) of dispersing and adhering the inorganic particles 45 onto a semi-dried first precursor layer 42', that is, onto the first precursor layer 42' having a slight fluidity, is performed. As described above, as the inorganic particles 45 of this embodiment, alumina is used. In the adhesion step of the inorganic particles 45 in this embodiment, while the roller main body 38 is axially rotated, the inorganic particles 45 formed of alumina are sprayed to the first precursor layer 42' so as to be dispersed on and adhered to the first precursor layer 42'. In this step, although various methods may be used as long as the inorganic particles 45 can be uniformly adhered to the first precursor layer 42', for example, a dry electrostatic powder coating method capable of selectively adhering the inorganic particles 45 to the first precursor layer 42' is more preferable. The inorganic particles 45 adhered to the semi-dried first precursor layer 42' are partially embedded therein, and the remaining parts of the inorganic particles 45 project from the surface of the first precursor layer 42'.

After the step of adhering the inorganic particles to the first precursor layer 42' is performed, a step (that is, corresponding to a step of forming the first layer by firing the precursor of the first layer to which the inorganic particles are adhered of the invention) of forming the first cover layer 42 is performed through a firing step (hereinafter, referred to as "first firing step") of firing the first precursor layer 42'. In the first firing step, the roller main body 38 is heated at a temperature of 70° C. or more for several tens of minutes to several hours. Accordingly, by a de-ammonium reaction of the polysilazane, the first precursor layer 42' which is the precursor is converted into a silica film to form the first cover layer 42, and the inorganic particles 45 are bound to the first cover layer 42. As described above, in this embodiment, since the amine-based catalyst is added to the first precursor layer 42', the firing temperature can be decreased.

Figure 10:
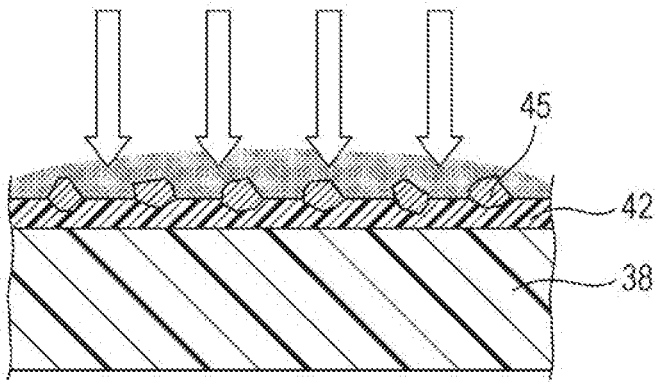
FIG. 10 is a view showing another step of manufacturing the medium transport device.
Figure 11:
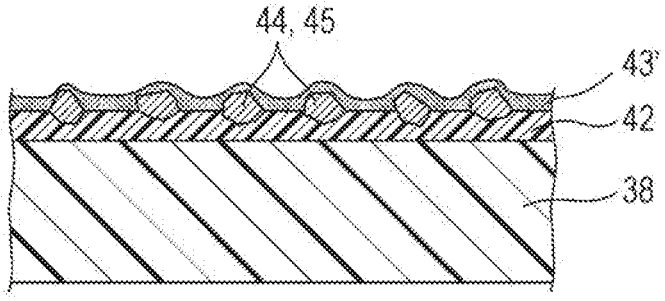
FIG. 11 is a view showing another step of manufacturing the medium transport device.
Figure 12:
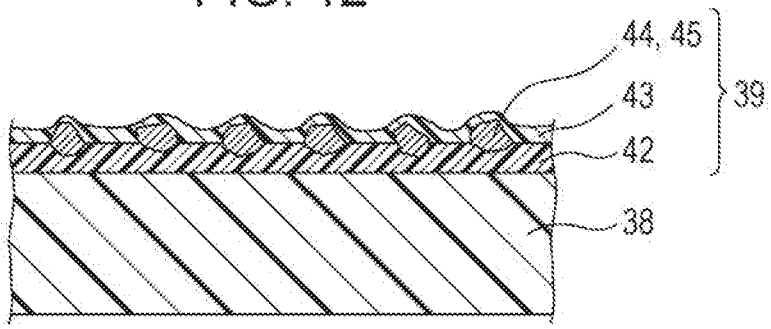
FIG. 12 is a view showing another step of manufacturing the medium transport device.

Subsequently, as shown in FIG. 10, a second washing step is performed. In this second washing step, as is the first washing step, $O_2$ plasma washing is also used. Next, as shown in FIG. 11, in the state in which the inorganic particles are bound by the first cover layer 42 formed on the surface of the roller main body 38, a step (that is, corresponding to a step of forming a precursor of the second layer on the first layer to which the inorganic particles are adhered) of forming a second precursor layer 43' to be formed into the precursor of the second cover layer 43 is performed. In this embodiment, as is the first cover layer 42, the second precursor layer 43' is formed by coating an organic solvent solution containing a polysilazane or the like as a film material by an electrostatic coating method onto a portion of the roller main body 38 on which the first cover layer 42 is formed. After the second precursor layer 43' is formed, a step (that is, corresponding to a step of forming the second layer by firing the precursor of the second layer of the invention) of forming the second cover layer 43 is performed through a firing step (hereinafter, referred to as "second firing step") of firing the second precursor layer 43'. In the second firing step of this embodiment, as is the first firing step, since the roller main body 38 is heated at a temperature of 70° C. or more for several tens of minutes to several hours, the second precursor layer 43' which is the precursor is converted to a silica film, so that the second cover layer 43 covering the first cover layer 42 and the inorganic particles 45 is formed. That is, the friction layer 39 formed of the first cover layer 42, the convex portions 44, and the second cover layer 43 is formed on the outer circumference surface of the roller main body 38, so that the feeding drive roller 28 according to the invention is obtained. In this case, the second cover layer 43 which is the outermost surface of the friction layer 39 has an irregular shape in conformity with the inorganic particles 45 bound by the first cover layer 42. That is, the friction layer 39 is formed to have a plurality of convex portions 44. Hence, the friction layer 39 is able to have a high friction force with the paper P.

As described above, by the inorganic particles 45 provided between the first cover layer 42 and the second cover layer 43, the feeding drive roller 28 can be formed so that the outer circumference surface thereof has the convex portions 44. In addition, since the inorganic particles 45 bound to the roller main body 38 by the first cover layer 42 are protected by the second cover layer 43, the inorganic particles 45 are not likely to fall off, and the durability of the feeding drive roller 28 can be improved while the friction force with the medium is secured. In this embodiment, since the first precursor layer 42' of the first cover layer 42 and the second precursor layer 43' of the second cover layer 43 are each formed of the compound containing a polysilazane, a silica film having high chemical resistance and durability is formed by firing, and as a result, the durability of the feeding drive roller 28 is further improved. In addition, according to the ink jet printer (printing apparatus) 1 of this embodiment, since there is provided the medium transport mechanism 5 capable of improving the durability of the feeding drive roller 28 while the friction force with the paper P functioning as the medium is secured, a product life can be improved.

In addition, of the first cover layer 42 and the second cover layer 43, at least the second cover layer 43 in direct contact with the medium is preferably formed from an inorganic material. The first cover layer 42 may be formed from, besides an inorganic material, a synthetic resin, such as an epoxy-based resin or a polyester-based resin. In addition, as the precursor of each cover layer, a metal alkoxide compound may also be used. As the metal alkoxide, any metal alkoxide may be used as long as a film formed therefrom as the first cover layer 42 or the second cover layer 43 has a solvent resistance and a higher durability.

In addition, in this embodiment, in both the step of forming a precursor of the first layer and the step of forming a precursor of the second layer, the case in which the precursor is formed by an electrostatic coating method is described by way of example; however, the method is not limited thereto, and at least one of the precursors may be formed by an electrostatic coating method.

Next, a second embodiment of the invention will be described.

FIGS. 14 to 19 are views each illustrating a step of manufacturing a medium transport mechanism 5 of a process of forming a printing apparatus 1 of the second embodiment, and in particular, are views each illustrating a step of forming a friction layer 39 of a feeding drive roller 28. In the first embodiment described above, although the manufacturing method in which the first precursor layer 42' and the second precursor layer 43' are each formed from the compound containing a polysilazane has been described by way of example, a compound containing a silsesquioxane may also be used instead of using the polysilazane. In this embodiment, a powdered film material containing a silsesquioxane is used. Hereinafter, the step of forming the friction layer 39 of the feeding drive roller 28 will be described mainly on the point different from that of the first embodiment.

Figure 14:
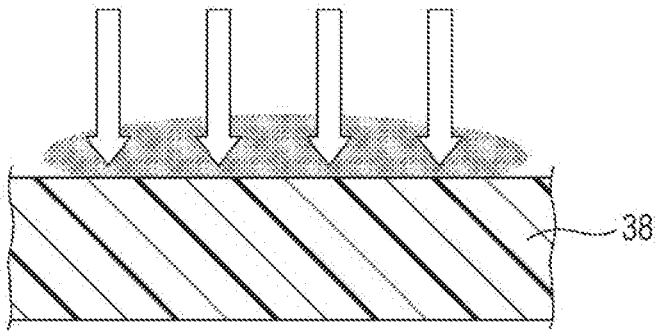
FIG. 14 is a view showing a step of manufacturing a medium transport device according to a second embodiment.
Figure 15:
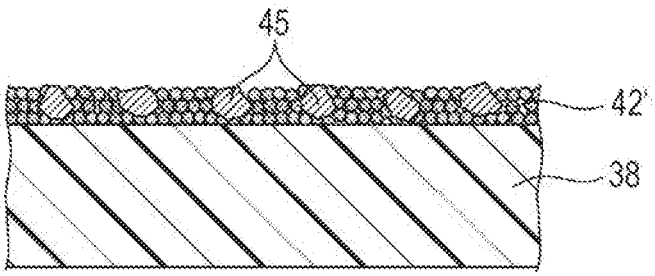
FIG. 15 is a view showing another step of manufacturing the medium transport device according to the second embodiment.

First, as shown in FIG. 14, after a first washing step of washing a roller main body 38 is performed as is the first embodiment, as shown in FIG. 15, a step of forming a first precursor layer 42' which is formed into a precursor of a first cover layer 42 is performed on the surface of the roller main body 38. In this embodiment, the powdered film material containing a silsesquioxane is coated on the surface of the roller main body 38 by a dry electrostatic powder coating method, so that the first precursor layer 42' is formed. In this embodiment, as the film material, a material formed by mixing a powder containing a silsesquioxane and inorganic particles 45, such as alumina, is adhered to the surface of the roller main body 38 by dry electrostatic powder coating. That is, as is the above dry electrostatic coating method, a nozzle and the roller main body 38 are relatively moved while the grounded roller main body 38 is axially rotated, and the film material thus charged is ejected from the nozzle, so that the film formation is performed. Accordingly, the first precursor layer 42' containing the inorganic particles 45 is formed. That is, in this embodiment, the step of forming the precursor of the first layer and the step of adhering the inorganic particles to the precursor of the first layer are simultaneously performed. The first cover layer 42 thus formed has an irregular shape since including the inorganic particles 45.

Figure 16:
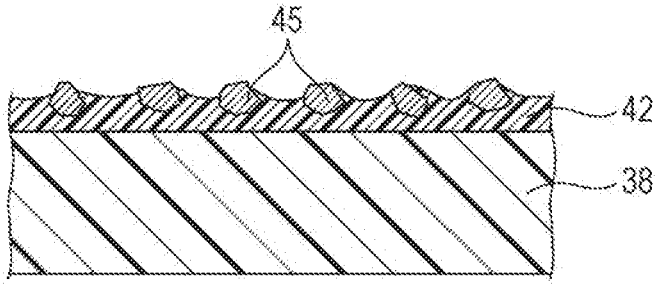
FIG. 16 is a view showing another step of manufacturing the medium transport device according to the second embodiment.

After the first precursor layer 42' including the inorganic particles 45 is formed, as shown in FIG. 16, a step (that is, corresponding to a step of forming the first layer by firing the precursor of the first layer to which the inorganic particles are adhered of the invention) of forming the first cover layer 42 is performed through a first firing step of firing the first precursor layer 42'. Accordingly, the first precursor layer 42' is liquidized once and is then cured, so that the first cover layer 42 is formed from a polysilsesquioxane. In addition, in this embodiment, although the structure in which the first precursor layer 42' is formed using the film material obtained by mixing the powder containing a silsesquioxane and the inorganic particles 45 is described by way of example, as is the above first embodiment, after the first precursor layer 42' is formed using a film material including no inorganic particles 45, a step of adhering the inorganic particles 45 to the first precursor layer 42' which is softened by a pre-heat treatment may be performed.

Figure 17:
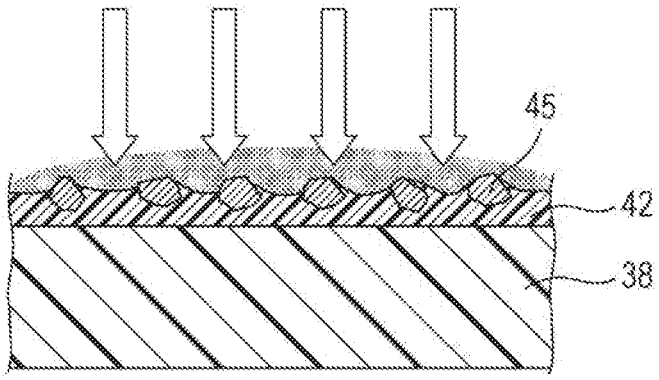
FIG. 17 is a view showing another step of manufacturing the medium transport device according to the second embodiment.
Figure 18:
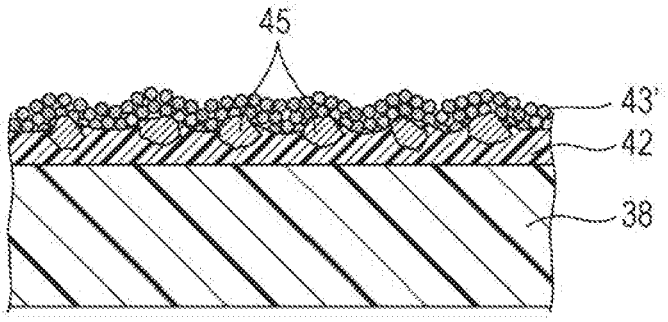
FIG. 18 is a view showing another step of manufacturing the medium transport device according to the second embodiment.
Figure 19:
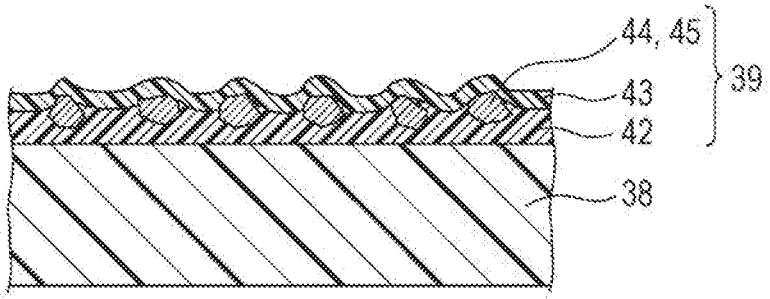
FIG. 19 is a view showing another step of manufacturing the medium transport device according to the second embodiment.

Subsequently, after a second washing step is performed as shown in FIG. 17, as shown in FIG. 18, a step (that is, corresponding to a step of forming the precursor of the second layer on the first layer to which the inorganic particles are adhered) of forming a second precursor layer 43' which is formed into a precursor of a second cover layer 43 is performed on the first cover layer formed on the surface of the roller main body 38 by an electrostatic powder coating method. In this step, unlike the step of forming the first precursor layer 42', in a powdered film material containing a silsesquioxane, the inorganic particles 45 are not included. After the second precursor layer 43' is formed, as shown in FIG. 19, a step (that is, corresponding to a step of forming the second layer by firing the precursor of the second layer of the invention) of forming the second cover layer 43 is performed through a second firing step of firing the second precursor layer 43'. Accordingly, the second cover layer 43 covering the first cover layer 42 and the inorganic particles 45 is formed. That is, the friction layer 39 formed from the first cover layer 42, the convex portions 44, and the second cover layer 43 is formed on the outer circumference surface of the roller main body 38, so that the feeding drive roller 28 according to the invention is obtained. In addition, the second cover layer 43 which is the outermost layer of the friction layer 39 has an irregular shape in conformity with the irregular shape of the first cover layer 42 including the inorganic particles 45. That is, the friction layer 39 is formed to have a plurality of convex portions 44. Hence, the friction layer 39 has a high friction force with the paper P.

As described above, in this embodiment, the feeding drive roller 28 can be formed so that the outer circumference surface thereof has the convex portions 44 by the inorganic particles 45 provided between the first cover layer 42 and the second cover layer 43. In addition, since the inorganic particles 45 bound to the roller main body 38 by the first cover layer 42 are protected by the second cover layer 43, the inorganic particles 45 are not likely to fall off, and the durability of the feeding drive roller 28 can be improved while the friction force with the medium is secured. In this embodiment, since the film formation is performed by electrostatic powder coating, the film can be formed without using an organic substance as a solvent, and hence, ignition is not likely to occur, so that the safety in the film formation is improved. In addition, since the cover layers 42 and 43 each formed from a polysilsesquioxane are so-called organic-inorganic hybrid materials having both inorganic characteristics by a siloxane bond and organic characteristics by an organic functional group, for example, even in the case in which the roller main body 38 is formed from a synthetic resin, a strong coating film can be formed on the surface of the roller main body 38. In addition, the other structures are similar to those of the first embodiment.

In addition, the invention is not limited to the above embodiments and may be variously changed and/or modified without departing from the scope of the invention. In the embodiments described above, although the case in which the medium transport device according to the invention is applied to the feeding drive roller 28 of the medium transport mechanism 5 is described, the medium transport device according to the invention is not limited thereto. For example, the invention may also be applied to the discharge drive roller 33 of the medium discharge mechanism 6. Furthermore, besides a medium transport device of a printing apparatus such as the above printer 1, for example, the invention may also be applied to a medium transport device transporting paper money which is one type of medium. The point is that as described above, the invention may also be applied to a device having a roller which comes into contact with a medium and rotates therewith to transport the medium.

What is claimed is:

1. A medium transport device comprising:
a roller transporting a medium;
a first layer covering a surface of the roller facing the medium;
a second layer laminated on the first layer; and
convex portions provided between the first layer and the second layer,
wherein the convex portions are formed by inorganic particles positioned between the first layer and the second layer.

2. The medium transport device according to claim 1, wherein the second layer includes an inorganic material.

3. The medium transport device according to claim 2, wherein the first layer includes an inorganic material.

4. A printing apparatus comprising:
the medium transport device according to claim 3; and
a printing portion which performs printing by ejecting a liquid to the medium.

5. A method for manufacturing the medium transport device according to claim 3, the method comprising:
forming a precursor of the first layer on the roller;
adhering the inorganic particles to the precursor of the first layer;
forming the first layer by firing the precursor of the first layer to which the inorganic particles are adhered;
forming a precursor of the second layer on the first layer to which the inorganic particles are adhered; and
forming the second layer by firing the precursor of the second layer.

6. The medium transport device according to claim 2, wherein the inorganic material includes an electrically conductive substance.

7. The medium transport device according to claim 6, wherein the electrically conductive substance includes carbon particles.

8. A printing apparatus comprising:
the medium transport device according to claim 7; and
a printing portion which performs printing by ejecting a liquid to the medium.

9. A printing apparatus comprising:
the medium transport device according to claim 6; and
a printing portion which performs printing by ejecting a liquid to the medium.

10. A method for manufacturing the medium transport device according to claim 6, the method comprising:
forming a precursor of the first layer on the roller;
adhering the inorganic particles to the precursor of the first layer;
forming the first layer by firing the precursor of the first layer to which the inorganic particles are adhered;
forming a precursor of the second layer on the first layer to which the inorganic particles are adhered; and
forming the second layer by firing the precursor of the second layer.

11. A printing apparatus comprising:
the medium transport device according to claim 2; and
a printing portion which performs printing by ejecting a liquid to the medium.

12. A method for manufacturing the medium transport device according to claim 2, the method comprising:
forming a precursor of the first layer on the roller;
adhering the inorganic particles to the precursor of the first layer;
forming the first layer by firing the precursor of the first layer to which the inorganic particles are adhered;
forming a precursor of the second layer on the first layer to which the inorganic particles are adhered; and
forming the second layer by firing the precursor of the second layer.

13. The medium transport device according to claim 1, wherein the inorganic particles include an aluminum oxide.

14. A printing apparatus comprising:

the medium transport device according to claim 13; and a printing portion which performs printing by ejecting a liquid to the medium.

15. A printing apparatus comprising:

the medium transport device according to claim 1; and a printing portion which performs printing by ejecting a liquid to the medium.

16. A method for manufacturing the medium transport device according to claim 1, the method comprising:

forming a precursor of the first layer on the roller;

adhering the inorganic particles to the precursor of the first layer;

forming the first layer by firing the precursor of the first layer to which the inorganic particles are adhered;

forming a precursor of the second layer on the first layer to which the inorganic particles are adhered; and forming the second layer by firing the precursor of the second layer.

17. The method for manufacturing the medium transport device, according to claim 16, wherein at least one of the precursor of the first layer and the precursor of the second layer includes a compound containing a polysilazane.

18. The method for manufacturing the medium transport device, according to claim 17, wherein the compound containing a polysilazane includes an amine.

19. The method for manufacturing the medium transport device, according to claim 17, wherein at least one of the forming a precursor of the first layer and the forming a precursor of the second layer includes an electrostatic coating method.

20. The method for manufacturing the medium transport device, according to claim 16, wherein at least one of the precursor of the first layer and the precursor of the second layer includes a compound containing a silsesquioxane.

* * * * *